US006786345B2

(12) United States Patent
Richards

(10) Patent No.: US 6,786,345 B2
(45) Date of Patent: Sep. 7, 2004

(54) FEEDING BOTTLES

(76) Inventor: David Charles Richards, Manor House, Everton Road, Everton, Near Lymington SO41 0HE (GB)

( * ) Notice: Subject to any disclaimer, the term of this patent is extended or adjusted under 35 U.S.C. 154(b) by 0 days.

(21) Appl. No.: 10/010,745

(22) Filed: Dec. 7, 2001

(65) Prior Publication Data

US 2002/0104815 A1 Aug. 8, 2002

(30) Foreign Application Priority Data

Dec. 7, 2000 (GB) ..... 0029883

(51) Int. Cl.[7] ..... A61J 9/04
(52) U.S. Cl. ..... 215/11.5; 215/11.1; 248/102
(58) Field of Search ..... 215/11.1, 11.2–11.4, 215/11.5, 11.6, 17–19, 24, 320, 321, 359, 361, 342; 606/234–236; 137/448, 903, 542; 248/302, 102, 105

(56) References Cited

U.S. PATENT DOCUMENTS

| | | | | |
|---|---|---|---|---|
| 307,630 | A | 11/1884 | Clark | 215/378 |
| 533,726 | A | 2/1895 | McBride | 215/11.5 |
| 1,732,126 | A | 10/1929 | Gardner | 215/11.5 |
| 1,743,293 | A | 1/1930 | Toft | |
| 1,976,450 | A | 10/1934 | Lowe et al. | 215/11.5 |
| 1,999,619 | A | 4/1935 | Reese et al. | 215/11.5 |
| 2,022,083 | A | 11/1935 | Geistlinger | 215/11.5 |
| 2,020,108 | A | 12/1935 | Crowl | 221/60 |
| 2,066,445 | A | 1/1937 | Allen | 215/11.5 |
| 2,529,794 | A | 11/1950 | Brown | 215/11.5 |
| 3,768,683 | A | 10/1973 | Van Den Bosch | 215/11.5 |
| 4,828,126 | A | 5/1989 | Vincinguerra | 215/11.5 |

FOREIGN PATENT DOCUMENTS

| | | |
|---|---|---|
| DE | 350295 | 3/1922 |
| FR | 761043 | 3/1934 |
| FR | 793995 | 2/1936 |
| GB | 871425 | 6/1961 |
| GB | 2 041 894 A | 9/1980 |
| WO | WO 98/38963 | 9/1998 |
| WO | WO 99/11218 | 3/1999 |
| WO | WO 00/54818 | 9/2000 |

*Primary Examiner*—Lien Ngo
(74) *Attorney, Agent, or Firm*—Heslin Rothenberg Farley & Mesiti P.C.; Victor A. Cardona, Esq.

(57) ABSTRACT

A feeding bottle (10) includes a teat assembly (14) and an air inlet (18) at its base. A stopper assembly (21) seals the aperture (18) and is manually operable to allow air flow through the aperture providing pressure equalisation within the bottle.

14 Claims, 13 Drawing Sheets

FIG. 2b
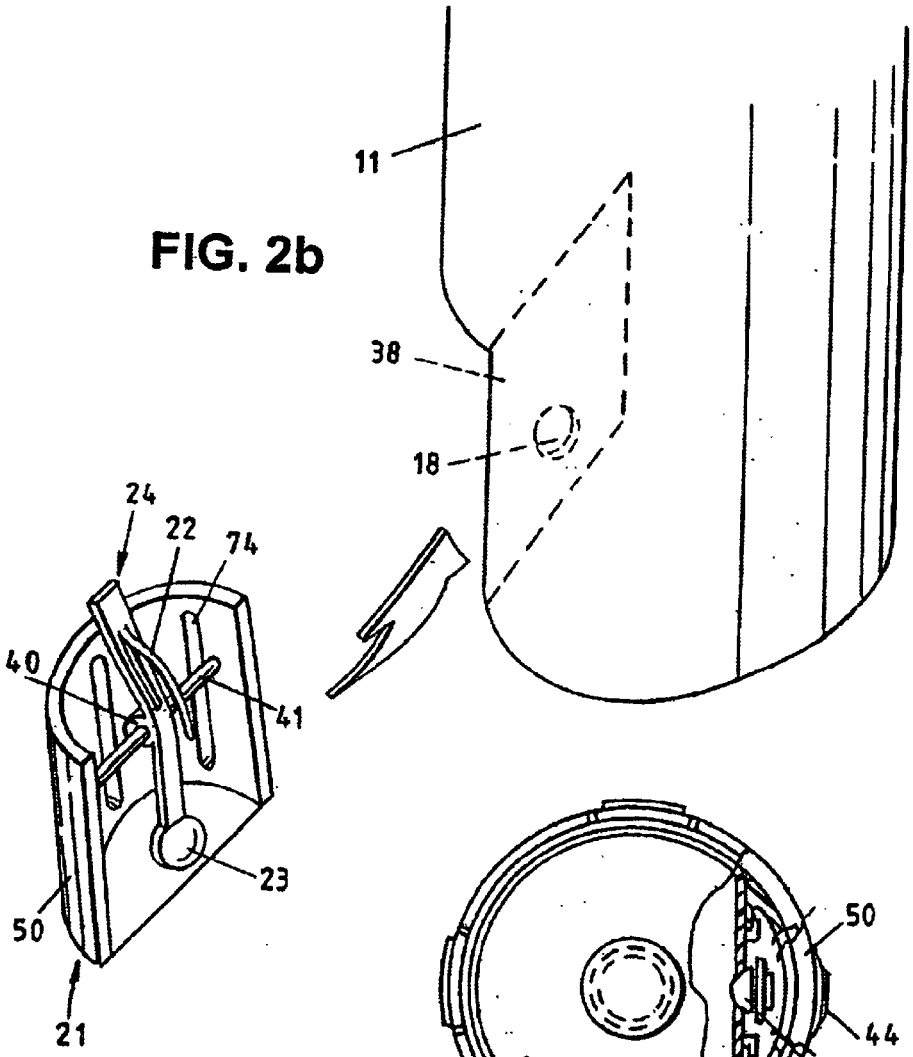
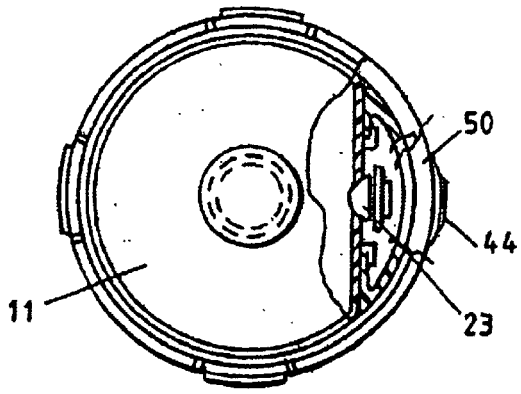
FIG. 3

FEEDING BOTTLES

CROSS REFERENCE TO RELATED APPLICATIONS

This application claims priority from Great Britain application 00.29883.6, filed Jul. 12, 2000, the entire disclosure of which is incorporated herein by reference.

The present invention relates to feeding bottles, for example feeding bottles for feeding babies and infants.

A range of feeding bottles are known, comprising a bottle body and a teat or nipple assembly, upon which a baby sucks to draw liquid (such as formula milk) stored in the bottle body out of the bottle body through the nipple.

A problem with conventional bottles is that as the baby sucks and liquid is drawn out of the bottle, a partial vacuum develops in the bottle body. It is believed that this can give rise to colic in babies. One hypothesis is that owing to the vacuum, when the bottle is in use air breathed in through the nose of the baby is drawn into the bottle through the nipple assembly, mixing as it does so with the liquid therein. Also, during feeding breaks, air is drawn into the bottle through the nipple assembly, leading to aeration of the liquid, particularly when the bottle is still partially inclined. The aerated liquid is then ingested by the baby causing colic. This can also give the baby wind with associated pain and stomach distension, and may lead to posseting.

Furthermore, the baby has to suck progressively harder to overcome the vacuum, and this can be off-putting and prematurely stop the baby feeding. Unwell, or weak babies may not be able to suck with sufficient force to overcome some vacuum strengths. Further still, the sucking action and the vacuum formed in the bottle body can lead to the baby experiencing ear-ache, or even developing an ear infection. Yet another problem is that a build up of the vacuum in the bottle can lead to nipple collapse.

In International Patent Application No. WO 99/11218 it is proposed to overcome some of these problems by the provision of a bottle vented by means of a perforated elastomeric diaphragm or "vent disc" attached to an open base of the bottle. When the bottle is inverted to feed the baby, air flows through a plurality of valves in the diaphragm to alleviate the vacuum in the bottle. When the bottle is upright, pressure equalises through the teat so that the valves are sealed.

However, inverting the bottle is not effective to open all the valves for all liquid levels, and so only partial vacuum alleviation is achieved. The plurality of valves are easily blocked, being necessarily of a small size and fragile in construction. The diaphragm is difficult to clean, particularly because the valves can be easily damaged. The complexity of the diaphragm means it is relatively costly and difficult to manufacture.

Another known solution is to use a disposable liner into which the liquid is placed, the liner being provided inside a conventional rigid bottle. The liner gradually collapses as liquid is drawn out. However, air is still drawn into the liner through the liquid aperture since sucking and reduction in liquid inside the liner leads to a vacuum forming in the liner. A mechanism to alleviate the vacuum is described in International Patent Application No. WO 98/38963 but requires a complex push-rod construction that is difficult to operate and inefficient. The liners are also not reusable, and thus the bottle is costly both to manufacture and use on a regular basis.

In addition known systems for filling and sealing bottles are known from, for example, International Patent Application No. WO 00/54818 (PCT/GB00/00928). However yet further improvements are envisaged to such arrangements.

Various other problems arise with known feeding bottles. Feeding bottles are conventionally heated to a desired temperature largely by trial and error, for example by the mother testing the temperature of the feed on her wrist. Various systems do not address the problem of taking a direct, accurate reading of the temperature of the feed. In addition in known systems there may "overshoot" in that the desired temperature may be exceeded such that the mother has to wait for the feed to cool down again as a result of the failure of take accurate readings of the feed temperature.

According to the present invention there is provided a feeding bottle comprising a bottle body including an open end for mounting a teat assembly, and an air inlet; and a stopper assembly, the stopper assembly being mounted to the bottle body and including a stopper manually moveable between a closed position in which the air inlet is closed by the stopper, and an open position in which the air inlet is open.

The feeding bottle of the present invention offers several advantages. When the bottle is not being used for feeding, the stopper can be moved to the closed position to prevent leakage of liquid from within the bottle body. When feeding, the stopper can be moved to the open position so that air can pass into the bottle body to alleviate, or control, any vacuum formed therein by the baby's sucking and subsequent liquid withdrawal. Liquid flow during feeding is improved. Also, because the vacuum is alleviated, less air is drawn into the bottle body through the teat assembly to mix with the liquid in the bottle body, and therefore the baby ingests less air. The bottle thus leads to a reduction in colic, ear-ache and/or infection, posseting, the need for babies to suck increasingly hard during feeding, and nipple collapse.

The bottle is of a simple construction that is reusable, simple to manufacture and easy to clean. Provision of an air inlet, rather than a plurality of perforations provided in a diaphragm, for example, means that the bottle of the present invention does not include a pressure-alleviation means that is prone to becoming ineffective due to clogging.

Preferably, the stopper is biased to the closed position. This means that the "default mode" for the bottle is that it does not leak.

Preferably, the bottle body includes a base end and the air inlet is provided at or near the base end. This has the advantage that when the bottle is in a feeding position and the stopper is moved to the open position, air is received into the bottle body to an area of the bottle body not occupied by liquid and there is no leakage.

Preferably, the stopper assembly includes a pivot arm bearing the stopper, the pivot arm being actuable to move the stopper between the open and closed positions. When the bottle is held in one hand in use, the pivot arm is preferably operable by one finger of the hand. It is therefore easy for the person using the bottle to feed a baby, to open or close the aperture as desired. The pivot arm further provides a mechanical advantage, together with the small stroke required by the stopper, allowing a strong biasing force to be applied to close the air inlet. Preferably this is done by placing the pivot arm near the stopper assembly such that gentle pressure is sufficient to overcome the strong sealing force.

Preferably, the stopper assembly is releasably attachable to the bottle body. This means that the bottle body and stopper assembly can be separated for ease of cleaning. The stopper assembly is preferably a slide and snap fit to the bottle body.

The stopper assembly may be pivotal to move the stopper between the closed and open positions, providing a bottle that is simple to use and manufacture.

Preferably, the bottle body includes a recess adapted to receive the stopper assembly. The bottle therefore retains its ergonomic appeal, since the stopper means can be located substantially flush with the bottle walls. The recess may be radiused to facilitate attachment of the stopper assembly to the bottle body. The bottle body may comprise a base end and side wall, the recess extending from the base end along a portion of the side wall. When the bottle is in use, this enables air to enter part of the bottle body not occupied by liquid.

The stopper assembly may further include a stopper retainer moveable between a first position in which the stopper retainer retains the stopper in the open position or a position permitting movement of the stopper between the open and closed positions; and a second position in which the stopper retainer retains the stopper in the closed position. The stopper retainer may in one embodiment enable the person using the bottle to feed a baby to lock the stopper into the open position when feeding; or optionally to lock the stopper into the closed position when the bottle is not in use to prevent leakage. The stopper retainer may comprise a slider. The slider may engage the pivot arm to respective sides of the pivot in each position.

Preferably the aperture is radiused to prevent the stopper jamming inside the aperture when the stopper assembly is slid off the bottle body.

Preferably, the stopper assembly includes an aperture alignable with the air inlet. Advantageously, it is therefore possible to insert a temperature sensing means into a bottle body contents without removing the bottle's nipple assembly, or completely removing the stopper assembly.

According to the present invention there is further provided a feeding vessel comprising a vessel body including an open end for mounting a mouthpiece assembly, and an air inlet; and a stopper assembly, the stopper assembly being mounted to the vessel body and including a stopper manually moveable between a closed position in which the air inlet is closed by the stopper, and an open position in which the air inlet is open.

The present invention further extends to a stopper assembly of the type herein described for the feeding bottle or vessel, the stopper assembly comprising a pivot arm bearing a stopper and biasing means for biasing the stopper to a closed position.

Additionally, the present invention extends to a feeding bottle stand adapted to support a feeding bottle when not in use so that the feeding bottle is inclined and points downwardly with respect to the horizontal.

The stand offers several advantages. For instance, the stand eliminates the need to place a bottle in a vertical position when not in use. Such a movement to a vertical position can aerate the liquid in the bottle body (leading to problems such as colic when the aerated liquid is ingested by the baby). When breast milk is used (which includes a negligable air content) the amount of air forced into the milk by bottle feeding methods can be kept to an absolute minimum.

Preferably, the stand is adapted to support the bottle as described above. Preferably, the stand supports the bottle such that the stopper assembly is provided on an uppermost surface of the supported bottle. Again, this minimises aeration of liquid in the bottle body since the bottle can be moved from the feeding position, to the stand in which it is supported at the same inclination without disturbing the liquid.

The stand may include heating means arranged to heat a bottle body content. This is useful to keep the contents warm or to heat it to a temperature suitable for use. It has been proposed that use of warm milk, rather than cold milk, can further reduce colic.

According to the invention there is further provided a mouthpiece assembly for a feeding and/or drinking vessel comprising a retaining ring, a mouthpiece and a mouthpiece plug, in which the mouthpiece is retainable by the retaining ring in each of a first, feeding position and a second, reversed, sealing position, the mouthpiece plug being sealable against the mouthpiece by the retaining ring in the second position.

The mouthpiece may comprise for example a teat for a feeding bottle, a spout of the type found in infant trainer cups.

As a result a simple and easy to use system is provided allowing a fully sterile bottle to be prepared. In particular the bottle can be filled to the brim with boiling water and the teat assembly screwed down onto it leaving a fully inert, sealed bottle.

According to the invention there is yet further provided a feeding bottle comprising a bottle body including an open end for mounting a teat assembly and a liner, the liner and bottle body having cooperating air inlet formations, the bottle further comprising a stopper assembly mounted to the bottle body and including a stopper manually movable between a closed position in which the liner air inlet formation is closed by the stopper and an open position in which the liner air inlet formation is open.

Because the liner can be pre-sterilised there is no need to sterilise the remainder of the bottle body. In addition the stopper assembly can provide evidence of tampering with the liner.

According to the invention there is further provided a feeding bottle filling station for a feeding bottle comprising a bottle body and a teat assembly, the station comprising at least one location for a bottle body and a teat assembly holding element laterally movable between a position suspended above the bottle body and a laterally spaced position and vertically movable between the suspended position and a bottle body engaging position. As a result a simple and efficient means of filling the feeding bottles is provided. This can be combined with a sealable system of the type discussed above to allow quick and if appropriate batch preparation of sterile, filled bottles.

Other optional features are set out in the dependent claims appended hereto.

Embodiments of the invention will now be described by way of example with reference to the accompanying drawings, in which:

FIG. 1 is a part-sectional side view of a feeding bottle according to a first embodiment of the present invention;

FIG. 2*a* is a side view of the feeding bottle of FIG. 1;

FIG. 2*b* is a perspective view of a detail of the feeding bottle of FIG. 1;

FIG. 3 is a horizontal cross section along the line A—A of the bottle shown in FIG.

Figure 5A:
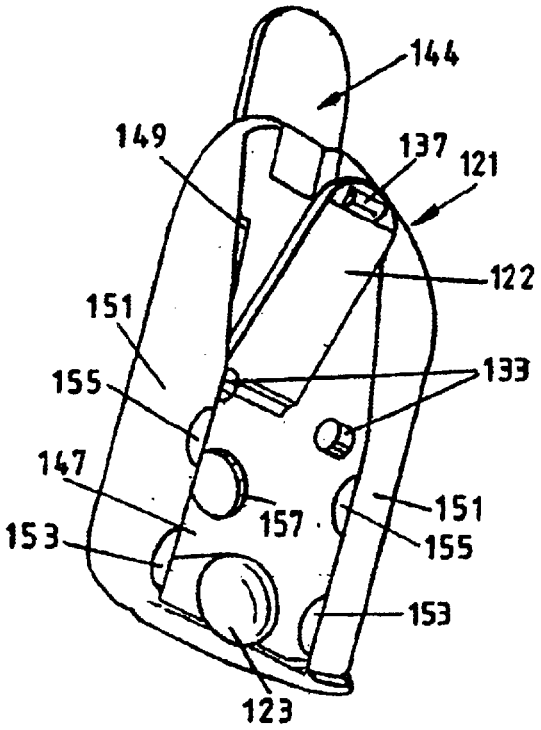
Figure 5B:
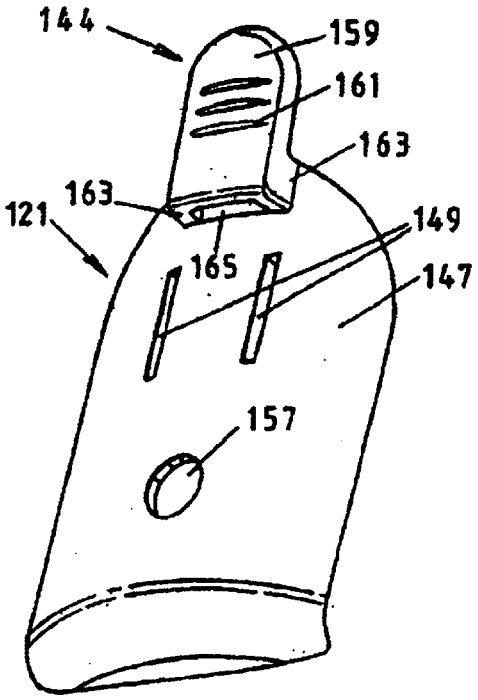
Figure 6A:
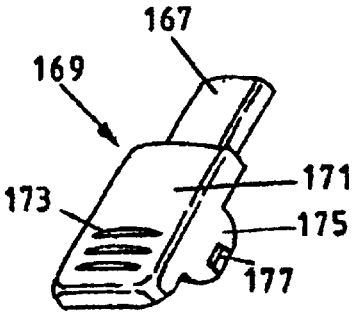
Figure 6B:
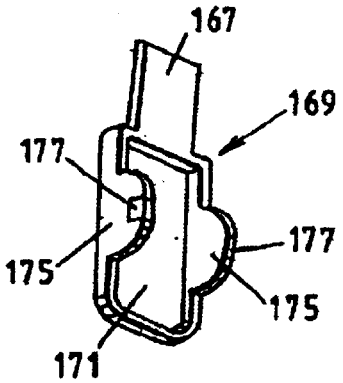
Figure 7:
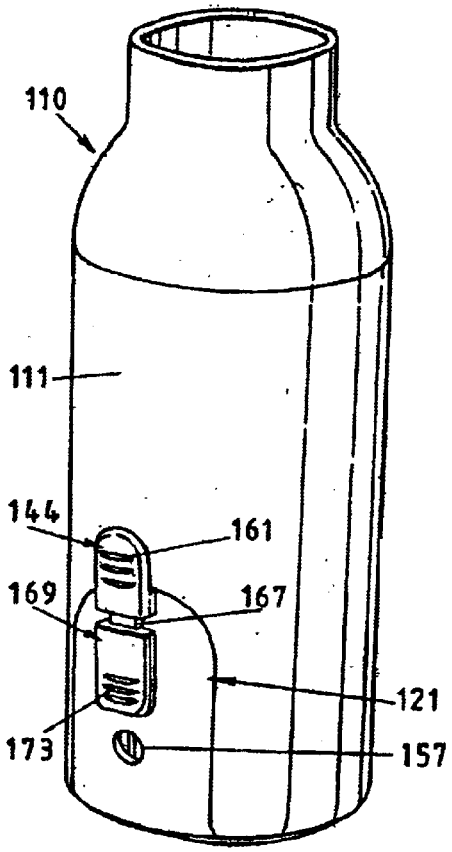
Figure 8A:
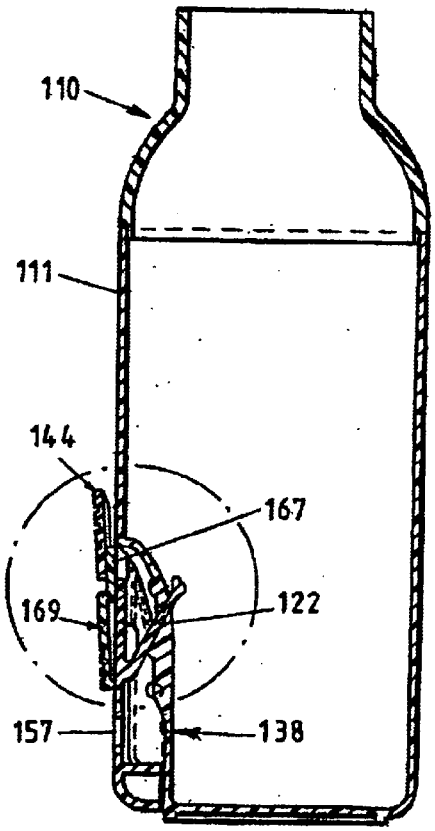
Figure 8B:
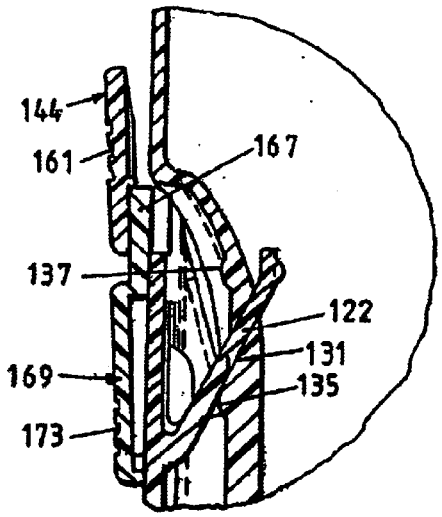

FIGS. 5*a* and 5*b* are rear and front perspective views, respectively, of a stopper assembly according to the second embodiment;

FIGS. 6*a* and 6*b* are front and rear perspective views, respectively, of a tab insert according to the second embodiment;

FIG. 7 is a perspective view of part of a bottle body, when attached to the stopper assembly according to the second embodiment;

FIG. 8*a* is a side view in section of the arrangement shown in FIG. 7;

FIG. 8*b* is an enlarged view of part of FIG. 8*a;*

Figure 9A:
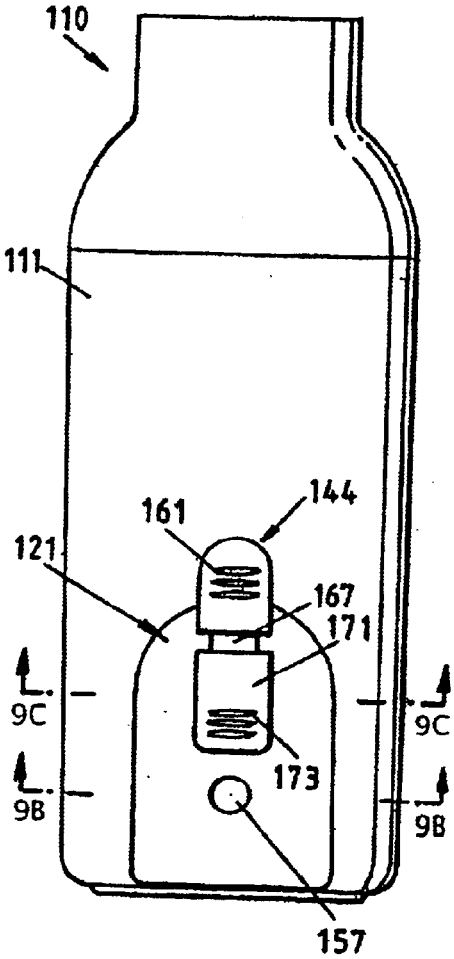
Figure 9B:
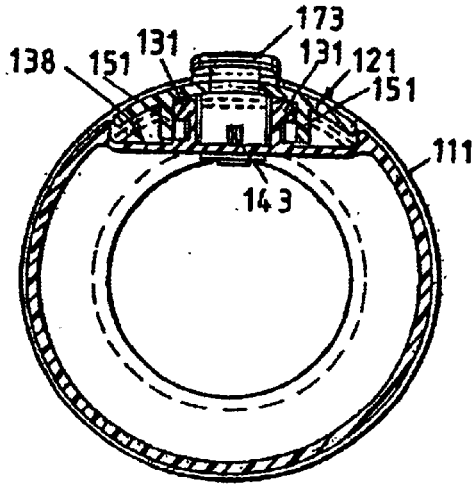
Figure 9C:
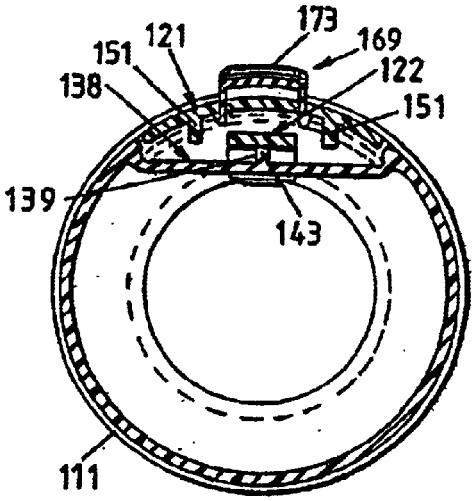

FIG. 9*a* is a side view of the bottle according to FIG. 7;

FIGS. 9*b* and 9*c* are sectional views along the lines C—C and D—D, respectively, of the bottle according to FIG. 9*a;*

Figure 10:
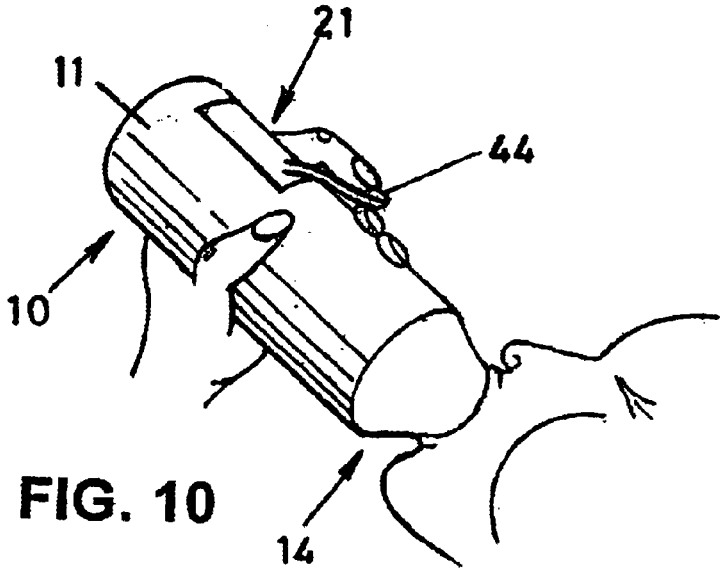
Figure 11:
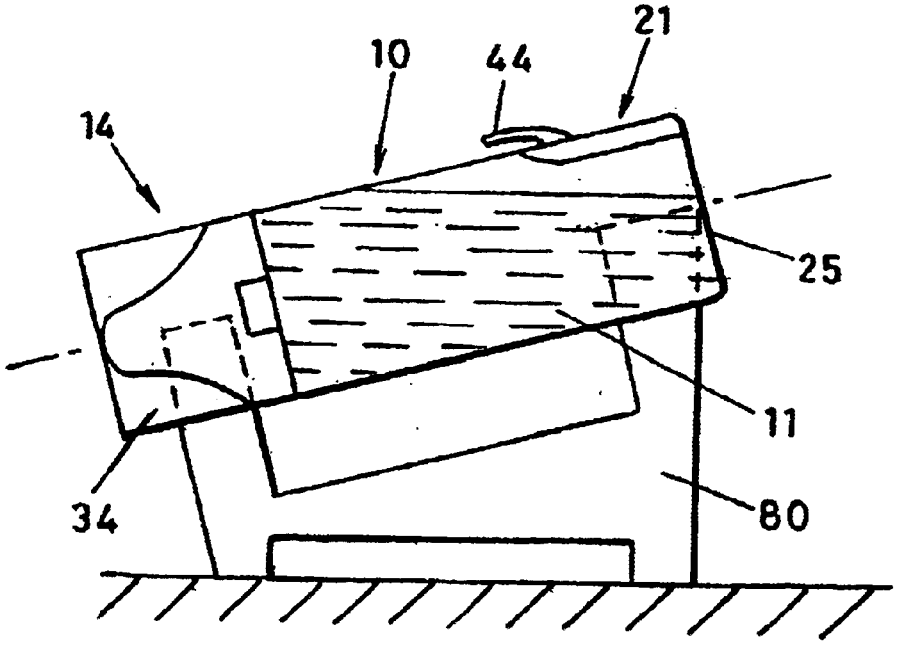
Figure 12A:
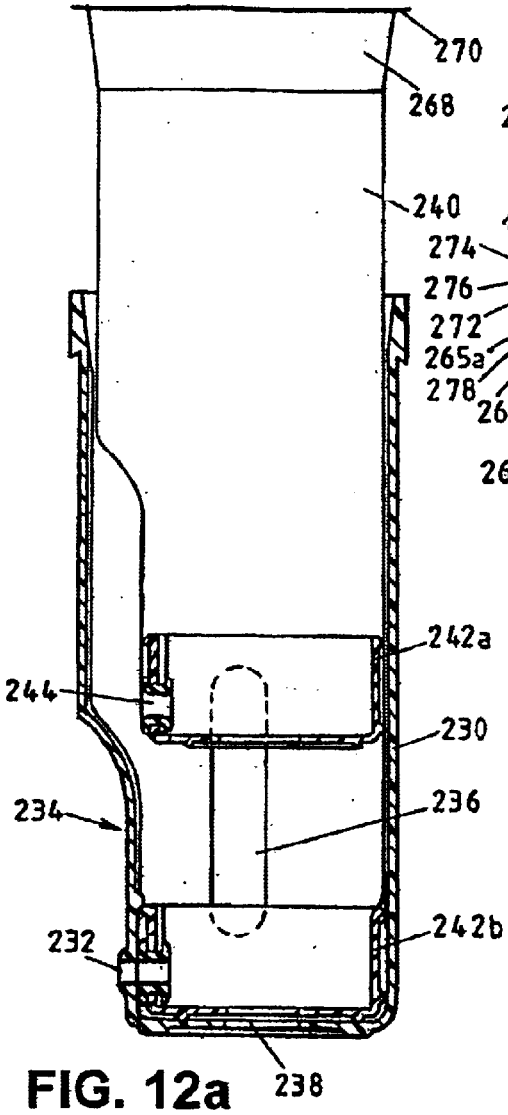
Figure 12B:
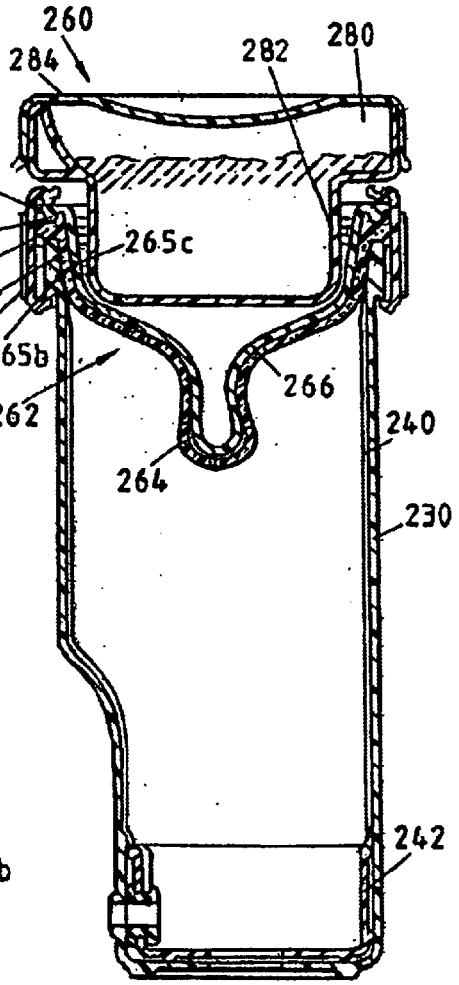
Figure 12C:
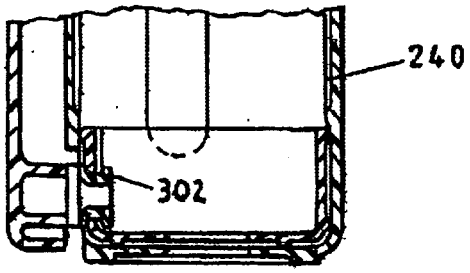
Figure 13A:
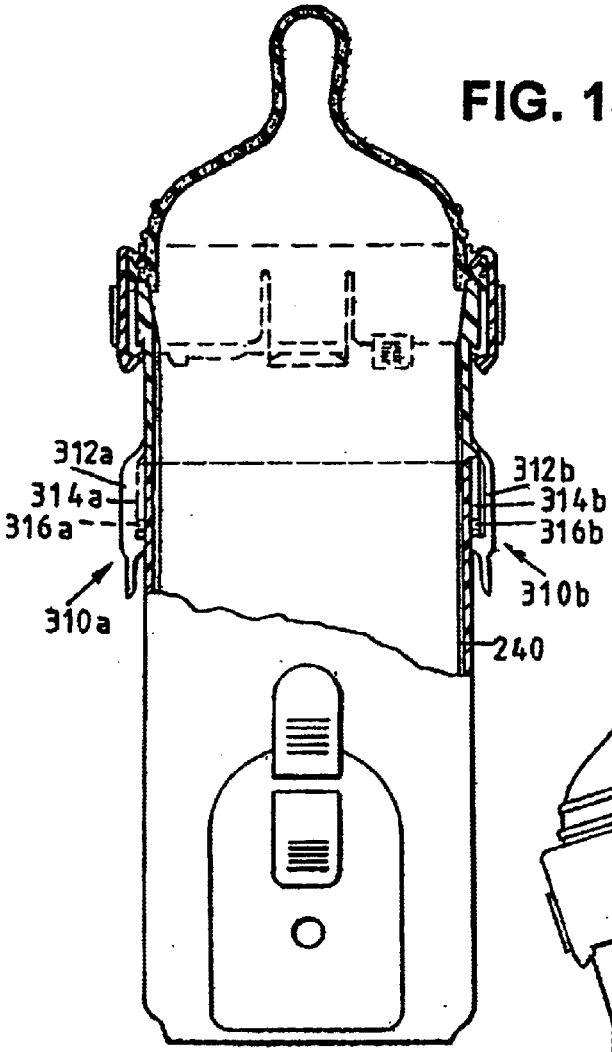
Figure 13B:
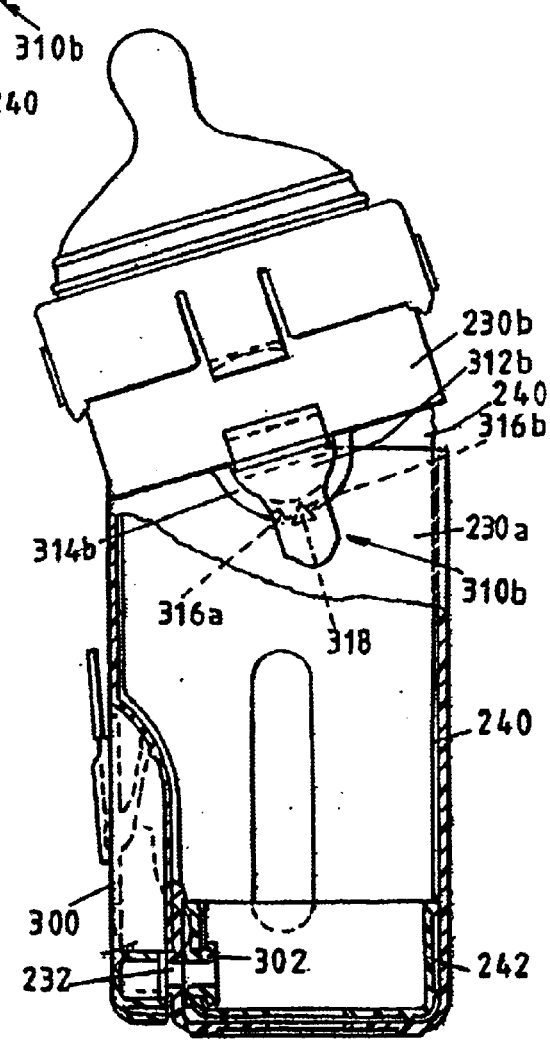
Figure 14A:
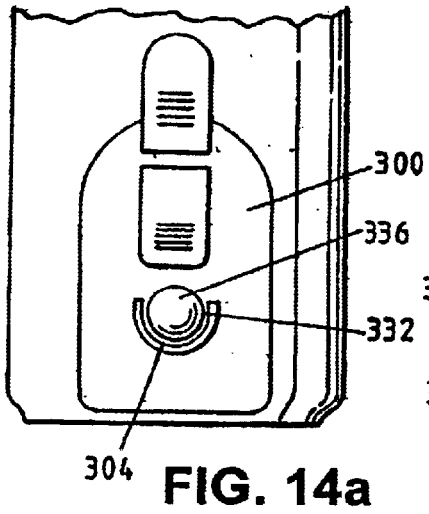
Figure 14B:
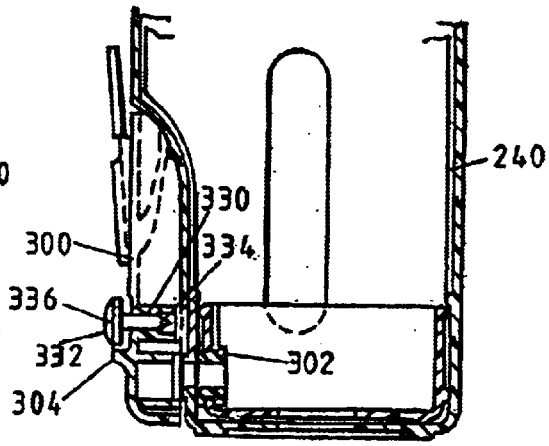

FIG. 10 shows the feeding bottle in use;

FIG. 11 is a part-sectional side view of the bottle supported by a stand according to a second aspect of the present invention;

FIG. 12*a* is a sectional side view of a third embodiment of the invention;

FIG. 12*b* is a sectional side view corresponding to FIG. 13*a* showing an assembled configuration;

FIG. 12*c* shows an alternative stopper assembly configuration according to the present invention;

FIG. 13*a* is a side view of a variable neck feeding bottle according to another aspect of the invention;

FIG. 13*b* is a front view of the bottle shown in FIG. 13*a* in an angled configuration;

FIG. 14*a* is a side view of a stopper assembly including a liner piercing mechanism;

FIG. 14*b* is a sectional front view corresponding to FIG. 14*a;*

Figure 15A:
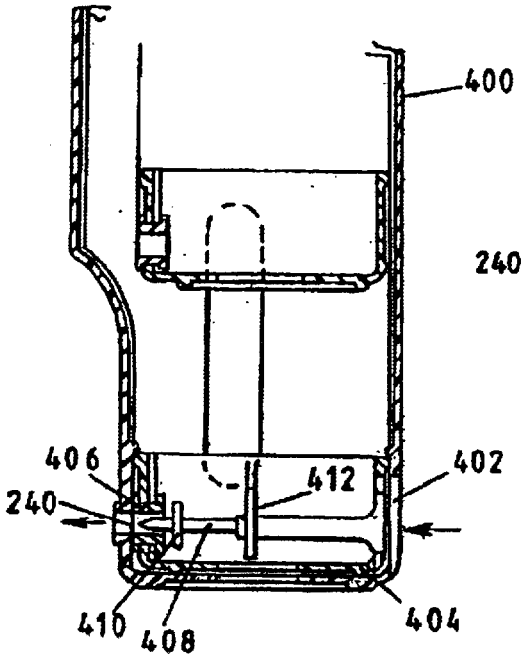
Figure 15B:
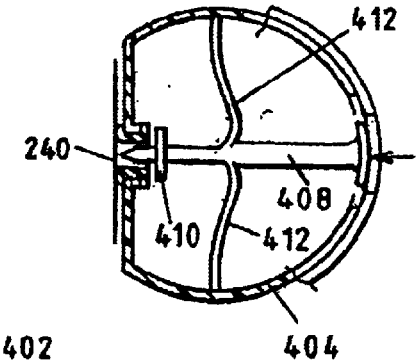
Figure 16:
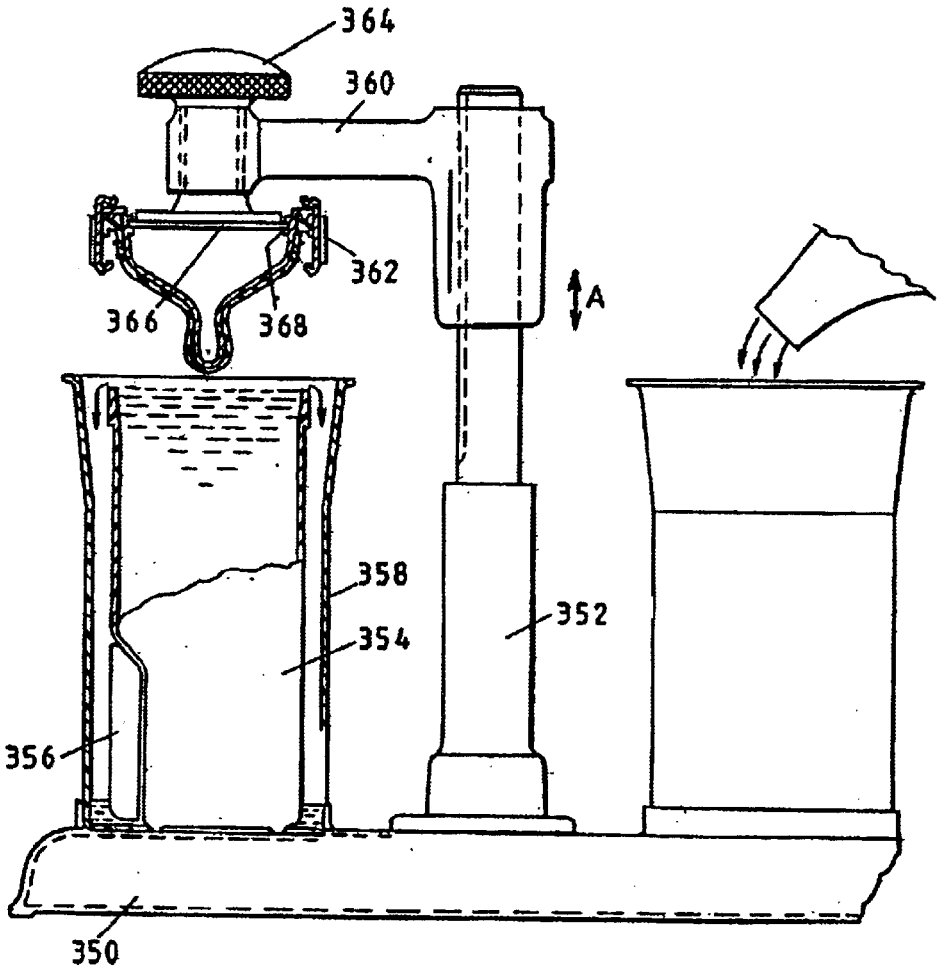
Figure 17:
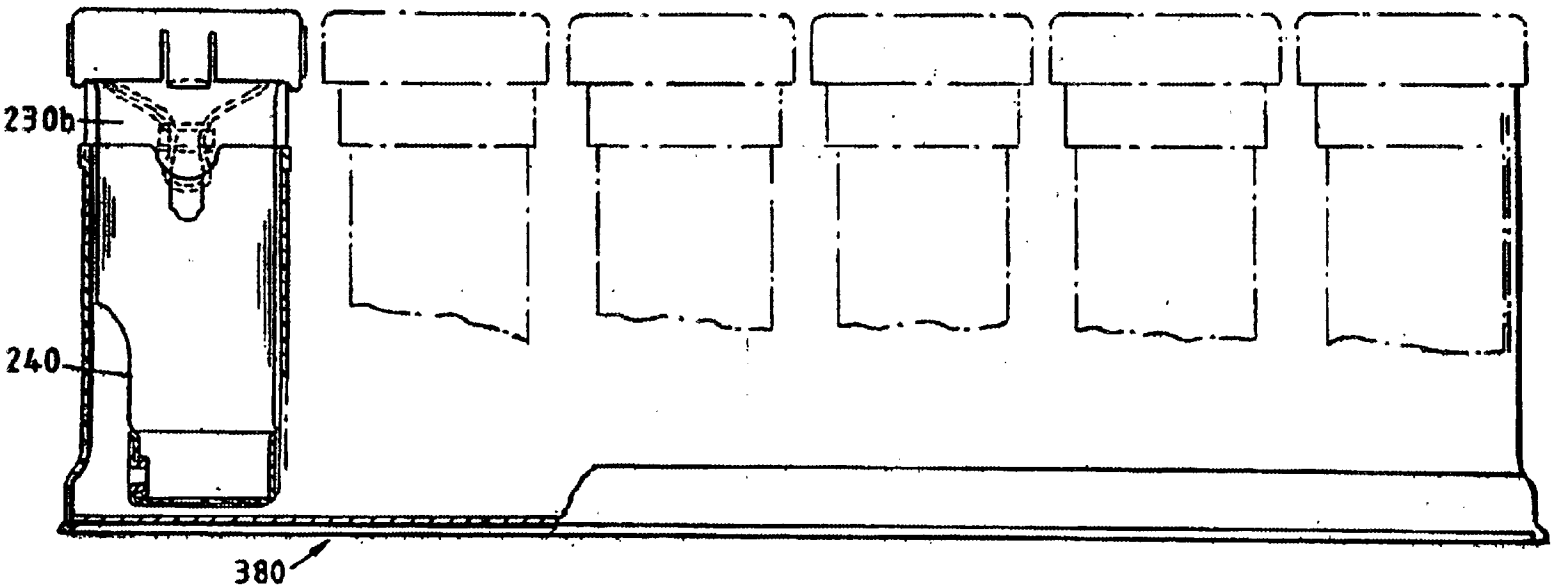
Figure 18A:
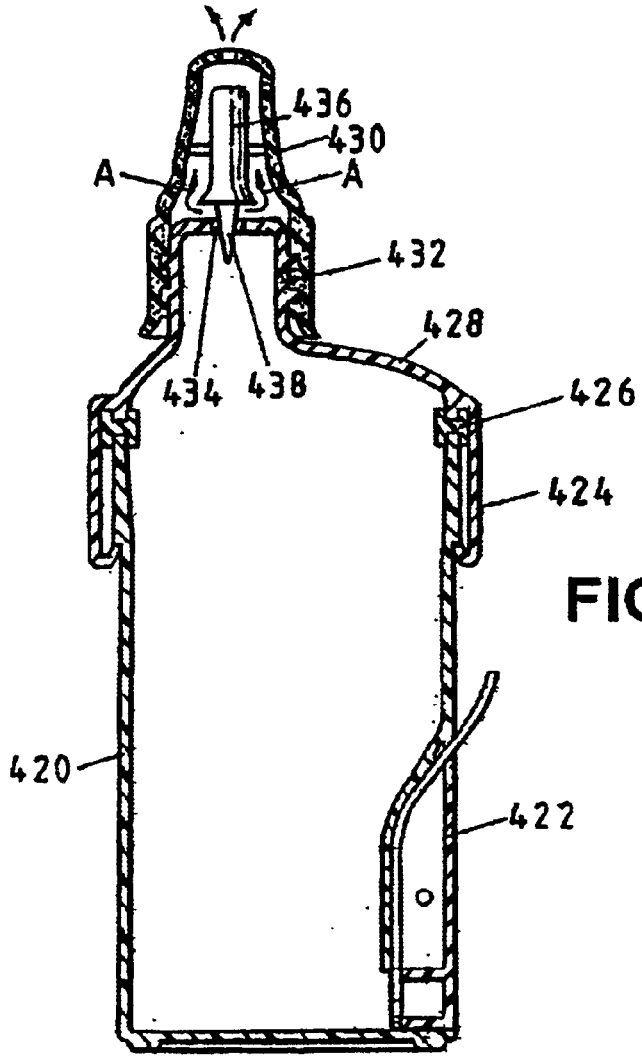
Figure 18B:
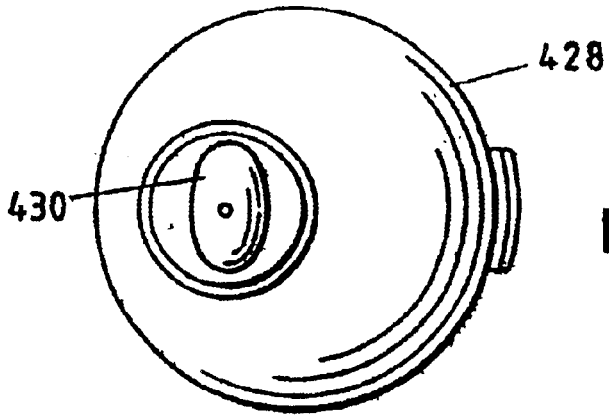

FIGS. 15*a* and 15*b* show a variant of FIG. 14;

FIG. 16 shows a feeding bottle station;

FIG. 17 is a schematic side view of a feeding bottle storage rack;

FIG. 18*a* shows a feeding bottle with a mouthpiece assembly in side cross-section; and FIG. 18*b* is a plan view corresponding to FIG. 18*a*.

In the following discussion the feeding bottle is described in its upright position unless otherwise indicated, and relative terms are to be interpreted accordingly such that, for example, "vertical" means parallel to the longitudinal axis of the bottle.

Figure 1:
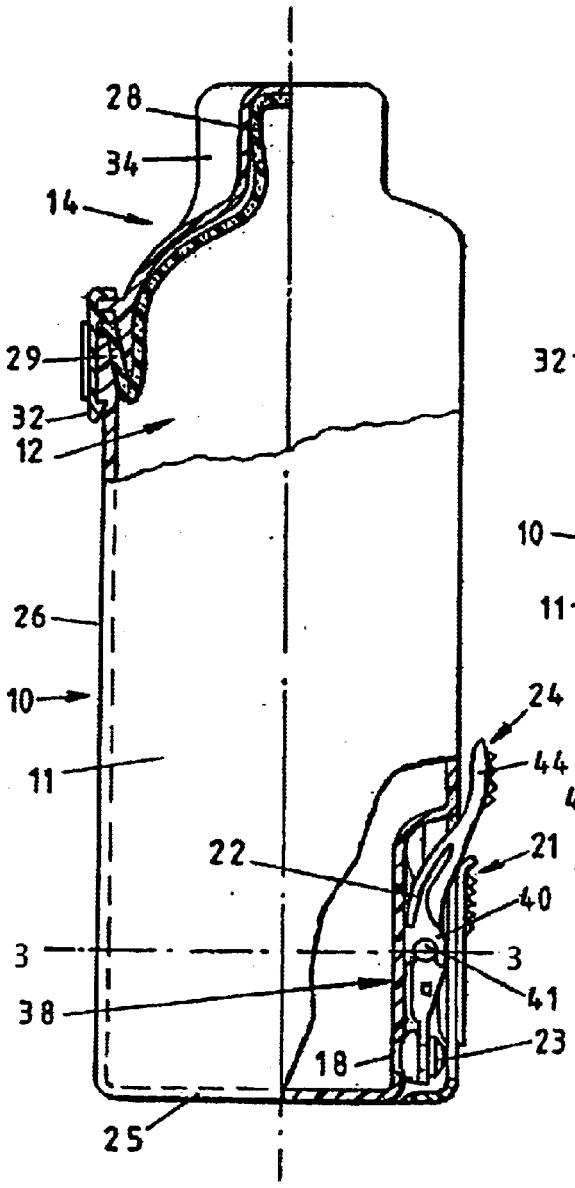

The main components of a first embodiment of a feeding bottle according to the invention will now be described with reference to FIG. 1. The bottle, shown generally at 10 in FIG. 1, comprises a main bottle body 11 with an open top end 12 through which the bottle is filled with feed, such as milk. A conventional teat or nipple assembly 14 is mounted to the open end 12 and includes a liquid aperture (not shown in FIG. 1) through which a baby can draw the liquid out from within the bottle body by sucking.

An aperture, or air inlet 18, is provided at the base of the bottle body 11. A stopper assembly 21 is mounted to the side of the bottle body 11 generally at its base for sealing the aperture 18 so as to "close" the aperture 18. A stopper 23 is mounted on a pivot arm 24 and biased to a closed position by a biasing means 22. The stopper 23 can be moved away from the aperture 18 allowing air to flow into the bottle body 11 by manual operation of the pivot arm 24 against the bias. The bottle 10 can thus be opened to the atmosphere at will when the baby is being fed. When not in use, the pivot arm 24 is in its resting, undepressed position; and the biasing means 22 acts upon the pivot arm 24 to force the stopper 23 to cover the aperture 18, so that liquid does not escape from the bottle body 11 through the aperture 18.

In use, the stopper assembly 21 is attached to the bottle body 11, and the bottle 10 with liquid therein is inclined to a feeding position (see FIG. 10). When feeding a baby, holding the bottle in one hand, the pivot arm 24 is in a position such that it can be depressed easily (for instance, with a forefinger) which results in the stopper 23 moving away from the aperture 18. Air can thus flow into the bottle body 11 to alleviate any vacuum formed therein from the baby sucking to remove liquid from the bottle 10. There is no leakage through the aperture 18 because of the inclination of the bottle, but when the bottle 10 is put down the pivot arm 24 can be released to close the aperture 18 and prevent leakage. In addition, feed can be very simply drained to the desired levels by opening the valve at the base allowing the user to observe the water level dropping to the desired level.

The feeding bottle 10 will now be described in more detail, with reference to FIGS. 1 to 3.

The bottle main body 11 is generally the shape of a cylindrical tube with a circular cross section, having a base 25, a side wall 26, and an open end 12. Preferably, the bottle body 11 is moulded from a rigid transparent plastics material, suitable for steam sterilisation.

Mounted to the open end 12 is the teat assembly 14 which comprises a nipple 28 of latex or other suitable material including a liquid aperture (not shown). The nipple 28 includes an annular flange adapted to fit over a rim 29 of the open end 12. A threaded retaining ring 32 which includes a central aperture through which the nipple 28 projects is adapted to be screwed onto a mating thread located around the open end 12. Finally, a protective cover 34 is mounted over the nipple 28 and ring 32. Preferably, as shown in FIG. 1, the cover 34 includes a downwardly projecting cylindrical portion received in a corresponding annular fold in the nipple 28 to form an improved seal between the cover 34 and nipple 28, and between the nipple 28 and bottle side wall 12, making use of the resilience of the nipple 28. The cover 34 can be a threaded bayonet fit to the retaining ring 32, to ensure a mating connection with the nipple 28 such that turning the cover tightens the connection and improves the seal.

The bottle body 11 includes a recess 38 in its side wall 26 extending from the base 25 partway up the bottle body 11. As best seen in FIG. 2*b*, the recess 38 generally comprises a cut-away segment of the bottle body 11, forming a flat rectangular face on the side of the bottle body 11. The aperture 18 is located along one wall of the recess 38. The aperture 18 is radiused to prevent the stopper 23 jamming in the aperture 18. In the embodiment shown, the stopper assembly 21 is releasably attachable to the bottle body 11 and received into the recess 38. As a result, the stopper assembly is easily cleaned. The recess 38 is also radiused to ease attachment of the stopper assembly 21 to the bottle body 11.

The stopper assembly 21 includes a yoke 40 for locating a pivot pin 41. The pivot arm 24, which is preferably rigid and in the form of an elongate lever member, pivots about the pivot pin 41 with the stopper 23 provided at the lower end of the pivot arm 24. The stopper 23 is hemispherical or domed such that it rests against the aperture 18, sealing it efficiently without jamming. The pivot arm 24 includes the biasing means 22, in the form of an integral resilient limb.

The biasing means 22 engages the bottle body 11 and urges the upper end of the pivot arm 24 away from the bottle body 11, hence pivoting the stopper 23 against the aperture 18 to close the aperture. In the configuration shown in FIG. 1, the pivot arm 24 is in its resting, closed position.

When the stopper assembly 21 is mounted on the bottle body 11, the pivot arm 24 is depressed by applying manual pressure to its upper free end 44 which projects outwardly of the stopper assembly 21 so as to be accessible to the user.

The free end 44 is located at a position along the side wall 26 such that it is convenient to press with a finger of a hand holding the bottle in a feeding position, as shown in FIG. 5. It is further spaced from the pivot pin 41 to provide a mechanical advantage to the user. The free end 44 is preferably ergonomically shaped.

Figure 2A:
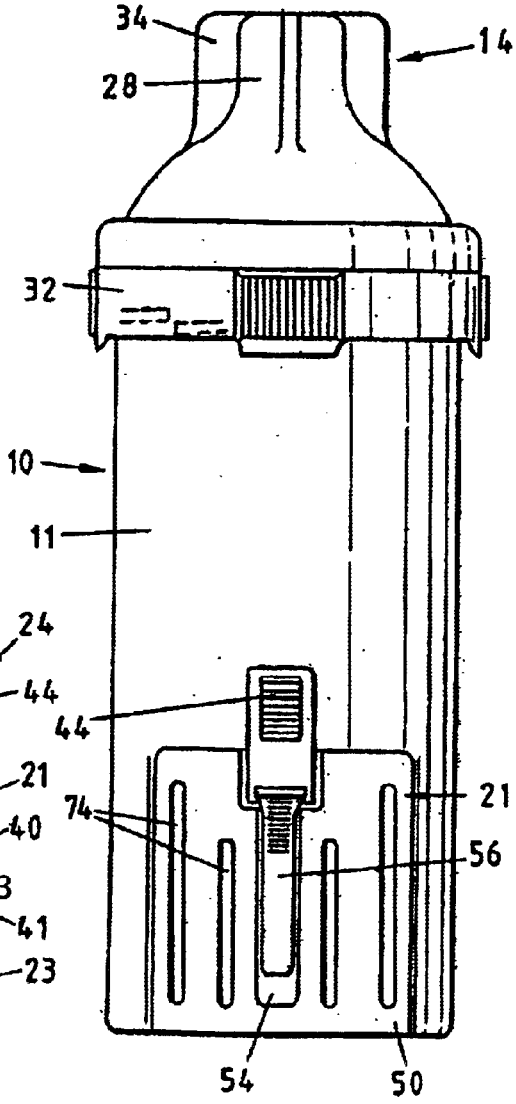

As seen in FIGS. 2*a* and 2*b*, the stopper assembly 21 includes a housing 50. The housing 50 is attached to the bottle body 11 by a slide and snap fit or other suitable attachment mechanism not shown. The housing 50 is preferably generally shaped so as to complement the profile of the bottle body 11 when the stopper assembly 21 is mounted to the bottle body 11.

The housing 50 includes on its outer curved face a central channel 54 running vertically. A stopper retainer comprising a slider 56, typically in the form of an elongated tab, is provided in the channel 54. The slider 56 is arranged to slide between one of preferably three positions, a detent (not shown) being provided for retaining the slider 56, in the absence of manual pressure, at each position.

In the first, upper position, shown in FIG. 2*a*, the slider 56 forces an upper part of the pivot arm 24 above the pivot pin 41 inwardly so that the stopper 23 is moved away from the aperture 18. This position is suitable for prolonged feeding if the person holding the bottle chooses not to hold down the free end 44. This position is also useful to expose the components of the stopper assembly 21 for sterilising (for example, in a dishwasher).

In the central, neutral position (not shown), the slider 56 does not affect the pivot arm 24.

In the lower position (not shown) the slider 56 forces the lower part of the pivot arm 24, below the pivot pin, inwardly so that the stopper 23 closes the aperture 18. This locked position is suitable, for example, when the bottle 10 is not in use, for example, to deter tampering. The recess 38 can be differently shaped and positioned and the stopper assembly 21 formed accordingly, as long as the aperture 18 is positioned so as not to leak when the bottle 10 is in use.

The stopper assembly 21 can be formed of, for example, rigid plastics components, the stopper 23 being of a flexible, resilient and preferably steam-proof material such as latex.

Figure 4:
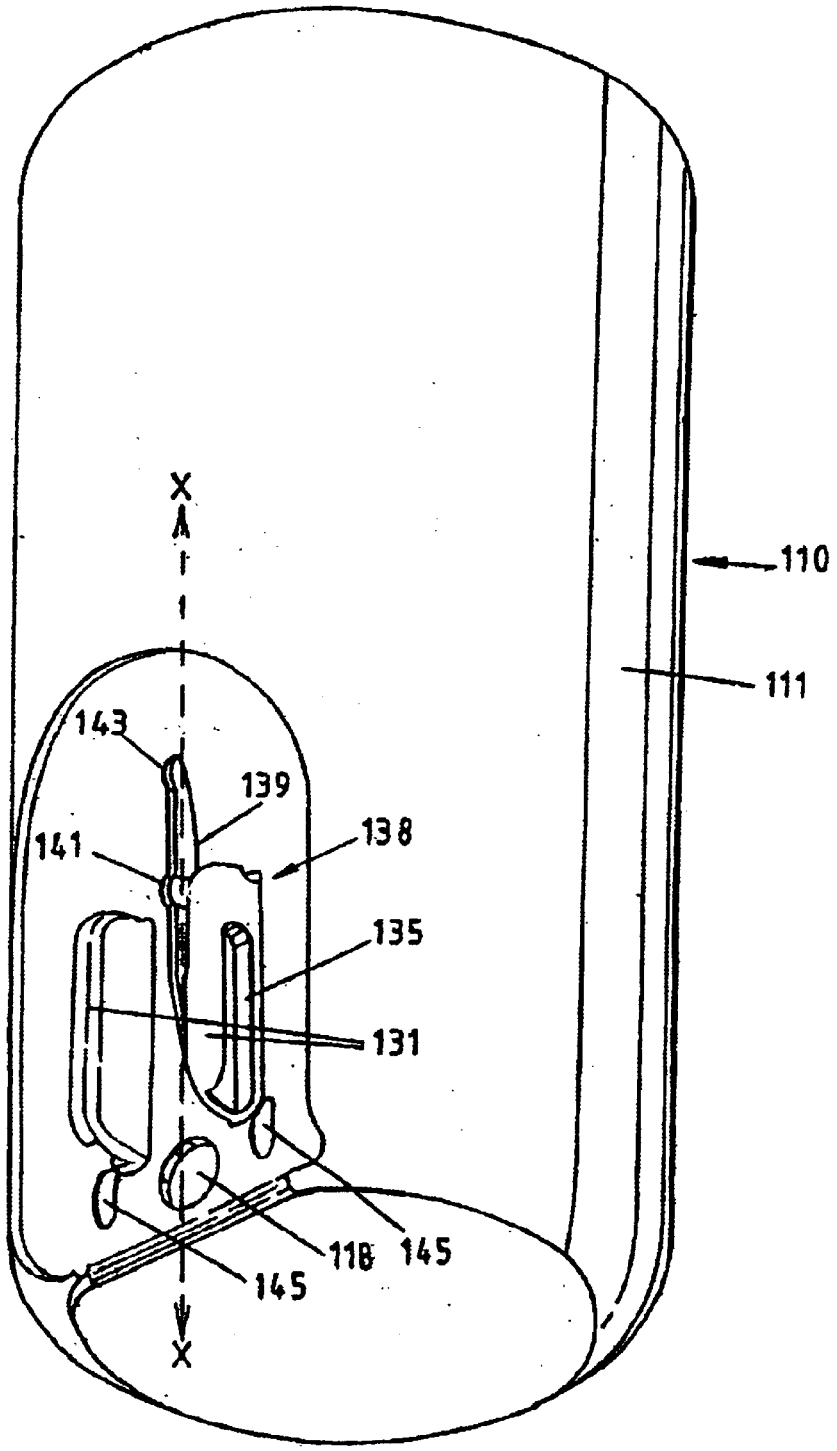
FIG. 4 is a perspective view of a part of a feeding bottle body according to a second embodiment.

A second preferred embodiment of the feeding bottle is shown in FIGS. 4 to 9. As shown in FIG. 4, an aperture or air inlet 118 is provided near the base of a recess 13 8 of a bottle body 111, which is part of a bottle 110 (shown only in part in FIG. 4). A pair of projecting formations or ribs 131 extend longitudinally along a portion of the recess 138. A stopper assembly 121, shown in FIGS. 5*a* and 5*b*, attaches to the recess 138 by a slide and snap fit, and is held in place by pivot lugs 133 co-operating with the ribs 131. The stopper assembly 121 includes a biasing means 122 that urges a stopper 123 to seal the inlet 118.

In use, depression of a tab 144 of the stopper assembly 121 pivots the stopper assembly 121 about the pivot lugs 133, so that the stopper 123 is moved away from the inlet 118. This allows pressure equalisation between air inside and outside the bottle 110.

Reverting to FIG. 4, the recess 138 comprises a cut-away segment for the bottle body 111, forming a flat rectangular face on a side of the bottle body 111. The aperture 118 is located centrally in the recess 138, near the base of the bottle body 111. The components attached (typically moulded) to the recess are substantially symmetrically disposed either side of a vertical mid-line X—X.

The pair of projecting ribs 131, or "guide channels", extend parallel to the X—X and either side thereof along a portion of the recess 138, and include side channels 135 (only one visible) in their respective outer side walls. Optionally, an elongate projection 139 is located mid-way between ribs 131 and extends along the X—X above the upper end of the ribs 131. The projection 139 preferably includes detents in the form of nubs—a lower, first detent 141, and an upper second detent 143. Finally, disposed either side of the inlet 118, below the ribs 131, is a pair of guiding means, or guides 145 generally in the shape of raised humps extending parallel to the line X—X.

The stopper assembly 121 for attachment to the recess 138, as shown in FIGS. 5*a* and 5*b*, comprises a flat main body 147 corresponding to the shape of the recess 138. Like the recess 138, the stopper assembly 121 is substantially symmetrical about a vertical mid-line (not shown). The main body 147 includes two channels 149 extending vertically along an upper section of the main body. Raised walls 151 are provided on the inner face of the main body that increase in height from the upper end of the stopper assembly 121 to reach a maximum height approximately mid-way along the vertical length of the stopper assembly 121 and extend the length of the main body. Along the lower, maximum height section of the walls 151, are a pair of first and second detent recesses 153, 155. The pivot lugs, or "pivot mounts", 133 are provided on inner sides of the raised walls 151, approximately mid-way along the vertical length of the walls 151.

The stopper 123 is provided centrally, near the base of the stopper assembly 121, and horizontally aligned with the first detent recesses 153, and comprises a sealing means in the form of a bung, or domed projection for example, suitable for sealing the air inlet 118.

Vertically above the stopper 123, a sensor aperture 157 (discussed in more detail below) is provided. The sensor aperture 157 is approximately equal in size to the inlet 118, and is horizontally aligned with the sealing assembly walls' second detent recesses 155.

The biasing means 122 is provided vertically above the sealing aperture 157, and projects from the sealing assemblies' main body 147 generally diagonally upwards. The biasing means is generally in the shape of a projecting tongue, that includes a tongue detent 137 at its distal end. Because the resistance of the material from which the assembly is formed, the tongue 122 will provide a restoring force if deformed towards the main body 147.

The tab 144 is located at the uppermost end of the stopper assembly 121, being integrally moulded thereto. The tab 144 extends vertically above the upper end of the stopper assembly 121, presenting a generally rectangular flat face 159 with tab ribs 161 for improved grip as shown in FIG. 5*b*. The tab is attached to and spaced from the front face of the main body 147 by a pair of side walls 163 that define a tab channel 165 between the tab 144 and the main body 147 as shown in FIG. 5*a*.

The tab channel 165 is suitable for receiving a tongue 167 of a tab insert shown generally at 169 in FIGS. 6*a* and 6*b*. The tab insert 169 comprises a main section 171, generally of a flat rectangular design with grip ribs 173 on an upper surface, as shown in FIG. 6*a*. A pair of ears 175 project downwards from either side of the main section 171, being provided mid-way along a vertical length of the main section 171. The ears 175 include tab insert detents 177 along their uppermost edge. The vertical extent of the ears 175 is less than, and typically half that of, the vertical length of the channels 149 of the stopper assembly 121 in which they are received. The tongue 167 of the tab insert 169 extends from the upper end of the main section 171, and is of a flat rectangular shape, to fit in the tab channel 165.

The components of the stopper assembly 121, and also those of the recess 138 and tab insert 169 may be integrally moulded, making the bottle easy to manufacture and clean. In addition a simpler arrangement is provided according to this embodiment which is easier to assemble and manufacture, and includes less moulded parts.

The upper end of the stopper assembly 121 is presented to the lower end of the recess 138, and then pushed onto and vertically upwards to attach to the recess in a slide and snap fit. The raised walls 151 of the stopper assembly 121 slide either side of the ribs 131, with the pivot lugs 133 received in the side channels 135. As the stopper assembly is progressively moved upwards, the guide humps 145 firstly engage the second detent recess 155 of the walls 151 of the stopper assembly 121. At the same time, the first projection retainer 141 of the projection 139 engages the tongue detent 137. In this configuration, the sensor aperture 157 and the inlet 118 are aligned. As the stopper assembly 121 is slid further into its attached position in the recess 138, the incremental height of the walls 151 riding along the guide humps 145 aide in lifting the stopper assembly 121 so that the stopper 123 does not foul the bottle base. In the final stage of attachment, the guide humps 145 engage the first detent 153 of the raised walls 152, and the second projection retainer 143 of projection 139 engages the tongue detent 137. In this "attached" configuration in which the stopper 123 is aligned with the inlet 118, the biasing tongue 122 is deformed inwardly to urge the stopper 123 to seal the inlet 118. It will be noted that the projection 139 on the bottle body is optional as the humps 145 provide an adequate detent and locating system.

The tab insert 169 is attached to the main body 147 as shown in FIG. 7. The ears 175 are received into the channels 149 of the stopper assembly main body 147 and retained there by tab insert detents 177—the arrangement is preferably pre-assembled therefore. The tongue 167 is inserted through the tab channel 165. FIGS. 8 and 9 show the stopper assembly 121 when fully assembled. The tab insert 169 is shown in a first configuration in these figures, in which the tongue 167 is only partially inserted into the tab channel 165. In a second configuration (not shown) the tab insert 169 is moved upwards so that the tongue 167 extends as far as possible through the tab channel 165, with the tab insert main section 171 abutting the front face of the tab 144. In this configuration, the tongue 167 is between the bottle body 111 and the tab 144, and therefore prevents movement of the tab 144 towards the bottle body preventing pivoting of the stopper assembly 121 about pivot lugs 133 to remove the stopper 123 from sealing the inlet 118.

In use, with the tab insert in the first configuration (whereby the tongue 167 is not inserted fully through the tab channel 165), depression of the tab 144 by application of a force in a direction towards the bottle body 111, causes the stopper assembly 121 to pivot about pivot lugs 133, thereby moving the stopper 123 away from the inlet 118. Air is then able to enter the inlet to equalise pressure inside the bottle 110. Upon release of the tab 144, the stopper assembly 121 pivots back to its resting position in which the stopper 123 is biased by the biasing means 122 to seal the inlet 118.

Moving the tab insert 169 vertically upward, so that the tongue 167 extends fully through the tab channel 165, prevents movement of the tab 144 so that the stopper assembly 144 is effectively locked, with the stopper 123 sealing the inlet 118.

When the stopper assembly 121 is partially slid out of the recess 138 with the guides 145 engaging the walls' second detents 155, and the first projection detent 141 of the projection 139 engaging the tongue detent 137; the alignment of sensor apertures 157 and inlet 118 permits insertion of a temperature sensor (not shown), such as a thermometer, into the bottle body 111 to detect a temperature of any liquid (not shown) therein.

This sensing position can be used for detecting liquid temperature when the bottle is stored on a stand 80 as shown in FIG. 11. In this arrangement the sensor can be formed together with the stand for example by being positioned on a hinged arm or in any other appropriate manner, and in communication with the stand. Accordingly the sensor can be positioned in thermal contact with the liquid in the bottle form a feedback loop to the stand to ensure that the liquid is retained at the correct temperature and/or issue an alarm signal when the liquid achieves the desired temperature. In a further desired embodiment the stand further incorporates a timer allowing the liquid to each the desired temperature at a predetermined time and issue an alarm to the user.

The stand 80 is adapted to support the bottle 10 when not in use at an angle inclined to the horizontal (and pointing downwards). This position preferably maintains the bottle 10 at a similar inclination to that of the bottle when being used to feed. By maintaining the bottle at this inclination, aeration of liquid within the bottle body 11 can be minimised. For example, the stand eliminates any need to place the bottle vertically, resting on its base 25, which encourages mixing between air and liquid inside the bottle body 11. It is aeration of liquid within the bottle body 11, that is subsequently ingested, that gives rise to problems such as colic, as discussed above.

Preferably, the bottle 10 is supported so that the stopper assembly 21 is on an uppermost surface of the supported bottle, further minimising liquid and air mixing. The heater (not shown) may be provided to keep the liquid at a desired temperature when resting in the stand, or to heat the liquid to a required temperature.

FIGS. 12*a* and 12*b* show a feeding bottle according to a third embodiment of the invention. FIG. 12*a* shows a feeding bottle body 230 including an air inlet 232 and recess 234 for a stopper assembly as described above. However the bottle body 230 further includes radially opposed slots 236 extending in the axial direction in the lower half of the bottle together with an aperture 238 in the base of the bottle body. A liner 240 having a configuration arranged to match the inside of the bottle body 230 is further inserted into the bottle body 230. The liner 240 is of any appropriate plastics material and is preferably flexible, sterile and capable of withstanding temperatures in the region of 100° C.

The liner is maintained in a sterile condition prior to insertion and includes a rigid or semi-rigid lower portion 242*a*/242*b* which in the embodiment shown in fact comprises a reusable insert placed at the base of the liner although this can alternatively be integral with the liner. The insert 242*a*/242*b* is shaped to match the internal base portion of the bottle body 230 and includes an aperture 244 which aligns with the aperture 232 in the bottle body. The liner 240 is dropped into the bottle body 230 and rests partway up as can be seen in the position denoted by reference number 242*a* showing the base of the liner. At this position the base is gripped from the outside of the bottle through slots 236 and the liner is drawn down to the bottom of the bottle such that the apertures 244,232 align as denoted by reference numeral 242*b*. To remove the liner 240 after use it can be pushed out using aperture 238 in the base of the bottle body 230. As can best be seen in FIG. 13*b* and 13*c*, the insert 242 includes a sealing sleeve 302 of generally cylindrical shape communicating with the external aperture in the bottle body 230. The sleeve 302 is preferably of rubber or other resilient material such that the liner material is stretched and sealed around the bottle body aperture 232 so that there is no leakage from the liner into the remainder of the bottle body when the liner is pierced. An alternative arrangement is shown in FIG. 12*c* in which the bottle body is cut away in the vicinity of the sleeve 302 such that the stopper assembly 300 seals directly on the sleeve 302 reducing the risk of seeping into the bottle body itself and also introducing no risk of contamination from the bottle body as this does not make contact with the liner in the vicinity of the sleeve 302.

Referring now to FIGS. 14*a* and 14*b*, one possible piercing means for providing a valve aperture for the liner is shown. In particular, means are provided on the stopper assembly 300 for piercing the liner 240. As discussed with reference to FIG. 9, the stopper assembly includes an aperture numbered here 330 allowing a sensor to be positioned in direct thermal contact with the liquid. Alternatively or in addition a pin 332 is mounted in the aperture or adjacent to it (not shown) having a sharp inner end 334 and a user pushable end 336. The pin 332 in its rest position, as shown, projects slightly from the stopper assembly 300 and is preferably sprung into that position. When the user wishes to pierce the liner the stopper assembly is slid down to a position in which the pin is aligned with the sleeve 302 in the liner and the pin is pushed inwardly to pierce the sleeve. A generally U-shaped portion 304 may be positioned on the stopper assembly partly surrounding the pin 332 to prevent accidental depression.

FIGS. 15*a* and 15*b* illustrate another possible piercing mechanism. In this arrangement the bottle body designated 400 includes an additional aperture 402 on its wall facing the air inlet. At the base of the liner is a flexible insert 404 carrying cylindrical sleeve 406. On the inside of the flexible insert is provided an elongate pin or piercing element 408 mounted to the side of the insert opposed from the air inlet sleeve 406. Accordingly the user simply presses the insert wall through the vessel body aperture 402 which pushes the pin 408 towards and through the liner opening the air inlet. When pressure is released the pin springs back to its open position allowing liquid to flow. The pin 408 preferably includes a disk-shaped stop 410 arranged to abut the sleeve 406 and prevent movement of the pin 408 beyond that point. As can be seen in FIG. 19*b* the pin 408 further includes flexible web portions 412 extending to the walls of the insert 404 ensuring that the pin is always maintained located in register with the cylindrical sleeve 406. This arrangement ensures that additional complexity is not required on the seal assembly and also ensures that the piercing element is maintained sterile as with the remainder of the contents of the liner.

For either piercing arrangement a similar arrangement can be provided in conjunction with the alternative stopper assembly shown in FIG. 12*c*.

As a result a simple reusable bottle body 230 and insert 242*a*/242*b* is combined with a cheap, readily disposable sterile liner 240.

Referring now to FIG. 12*b* a feeding bottle generally designated 260 is shown in a closed, sterile condition. The bottle body 230 houses a liner 240 having an insert 242 as discussed above. The top of the bottle body 230 is sealed by a teat assembly 262 including a teat 264 depending downwardly into the bottle body and a teat plug 266 inside the teat 264 and arranged to close the aperture of the teat (not shown). The liner 240 includes a slightly outwardly flared upper portion 268 and an annular flange at the top 270. The annular flange 270 rests on the top face of the bottle body 230 and is sealed there by the flange of the teat 264 which has an H-shape in cross-section such that the liner flange 270 is received between the lower limbs of the teat flange 264. The teat plug 266 includes an annular flange 274 having an annular rib 276 received between the upper limbs of the teat flange 272. In addition, to remove the need for the teat 264 to seal against the teat plug 266 across its entire surface, beads 265*a*, 265*b*, 265*c* are provided around the circumference of the teat near its open end. Two of the beads 265*a* and 265*b* are provided on the outer face of the teat 264, slightly axially spaced, to seal against the inner face of the bottle body 230 (or liner 240 where one is provided). The third bead 265*c* is provided on the inner face of the teat 264, between the external beads, to seal against the teat plug 266. As a result of the resilience of the teat material a strong and reliable seal is provided. The seal is enhanced by staggering the beads as described above which bends the teat material in their vicinity to improve the seal. It will be recognised that a suitable seal can be achieved with fewer beads as appropriate.

A collar 278 of the type discussed above is a snap or bayonet or screw fit onto the bottle body holding the teat plug, teat and liner flange in sealed relationship against the bottle body. In the preferred embodiment the bayonet fit includes an interrupted thread on the bottle body such that the collar can be slid onto the bottle and twisted to drive it downwardly into an appropriate seal. In addition a feed capsule 280 is retained within the teat plug 266 for example by virtue of a circumferential rib on the feed capsule engaging a circumferential channel on an inner face of the teat plug as shown generally at 282. The feed capsule 280 can be disposable with a tear off lid or, as shown, prefilled by the user and with a snap fit lid 284.

In use, once the liner 240 is inserted in the bottle body 230 it is filled with boiling water and the teat 264 is sealed in place as shown in FIG. 12*b* by collar 278. As a result the teat and liner are maintained in a sterile condition. The teat can be pre-stressed by the teat plug 266 such that even as the boiling water contracts on cooling the teat aperture remains closed. The seal is enhanced further by virtue of the engagement of the teat with the flared section 268 of the liner against the bottle body 230. Preferably the teat plug urges the teat outwardly in the vicinity of the liner flared portion 268. When it is desired to feed an infant the collar 278 is removed and the teat lifted and reversed with the teat plug detached. A stopper assembly of the type discussed above is slid into place and the liner pierced through the aperture 232 and 244 as discussed in more detail below allowing the level of the water or liquid in the bottle to be drained to the desired level. The aperture is then closed. These can then be prepared for example by introducing the powdered feed in feed capsule 280 and the bottle heated as is well known. In a further alternative embodiment the sterile liner 240 is prefilled with sterile water or other potable liquid such as fruit juice or suitable sterilised milk, providing a simple and straightforward, pre-packaged drinking system. In that case the teat assembly 262 can include a piercing portion such that as the teat assembly is mounted the liner is pierced. The pre-filled liner concept can be applied to alternative feeding or drinking vessels and mouthpiece assemblies.

FIGS. 13*a* and 13*b* further illustrate a variant of the second embodiment in which a variable angle neck is provided. In particular the bottle body includes a lower portion 230*a* and an upper portion 230*b*, the upper portion snapping on to the lower portion at diametrically opposed points 310*a*, 310*b*. Respective snap tabs 312*a*,312*b* project downwardly on each side of the upper portion 230*b* and engage over respective raised semi-circular portions 314*a*, 314*b*. Each semi-circular portion 314*a*,314*b* includes at least two grooves 316*a*,316*b* selectively engaged by an index 318 on the snap tab 312. As a result the upper portion 230*b* pivots about a diameter of the lower portion 230*a* and is movable to at least two positions defined by grooves 316*a*,316*b*. The position defined by groove 316*a* is preferably an aligned position such that the bottle body 230 is effectively straight. Alternatively an angled neck position is shown in FIG. 13*b* as defined by groove 316*b*. Liner 240 can be seen in FIG. 13*b* and provides an element of sag or flexibility accommodating pivoting of the upper portion 230*b*. The liner seals to the upper portion 230*b* in the same manner as discussed in relation to FIG. 12*b*.

As a result a variable angle neck bottle is provided and a plurality of different positions can be defined by an appropriately formed pivot connection between the upper and lower portions of the bottle body. A preferred ergonomic position can therefore be adopted by the user which will further enhance the comfort and ease of use of the lever operated stopper assembly discussed above. In addition the angled neck configuration is thought to provide some benefits in relation to prevention of colic which will cooperate with the stopper assembly to enhance the anti-colic operation yet further.

It will be appreciated that the sealing arrangement shown in FIG. 12*b* can be applied equally to a feeding bottle of the type described with reference to FIG. 4 et seq can be closed by inverting and sealing the teat as discussed with reference to FIG. 12. In either versions an advantage of a sealed arrangement of the type including an aperture at the base is that the aperture can be used as a tamper detecting arrangement. The sealing arrangement can be pursued independently of the valve arrangement and applied to other feeding or drinking vessels and other mouthpiece assemblies as appropriate. If the seal within the body is imperfect, as a result of which the liquid retained in the bottle may be contaminated, then upon opening the aperture in the base liquid will escape from the bottle because of the imperfect air lock. If, however, there is a perfect seal then as long as the aperture in the base is of appropriately small size (for example 3–5 mm) no water will escape as there is no air inlet. The valve assembly further acts as a pressure relief valve for example where the bottle is overheated in a microwave oven.

Referring now to FIG. 16 a feed station for filling the feeding bottles according to the second embodiment is shown schematically. The feed station includes a base 350 which is preferably hollow and includes apertures at its upper end to collect excess water. The base is generally circular in plan view and holds, for example, six feeding bottles based equidistantly around a central pillar 352. In the embodiment shown each feeding bottle 354 including stopper assembly 356 is received in a cylindrical housing 358 of slightly greater diameter and height, to collect overflow water and direct it into the base 350. Alternatively, of course, the feeding bottle 354 can be received in appropriately apertured formations allowing drainage into the base 350. The system is appropriate for a drinking bottle 354 with or without additional liners.

Mounted on the pillar 352 are one or more teat assembly arms 360 projecting radially from an upper end of the pillar and carrying a teat assembly 362. The teat assembly arm 360 preferably reciprocates up and down on the pillar 352 as designated by arrow A. Where only a single teat assembly arm is provided, a first bottle 354 is filled with boiling water whilst the teat assembly arm is rotated out of alignment to allow ease of pouring. The teat assembly arm 360 is then rotated into register with the feeding bottle 354 and depressed such that the teat assembly 362 snap fits over the feeding bottle 354 as discussed above. The teat assembly arm may include a knurled or twist portion 364 which the user manually twists to engage the bayonet fittings between the teat assembly 362 and feeding bottle 354. The teat assembly 362 is loosely mounted to the teat assembly arm 360 via a disk 366 on the teat assembly arm engaging an annular channel 368 on the teat assembly which may be in the same channel as is used to mount the feed capsule 280 (see FIG. 12*b*). As a result when the arm assembly is lifted up, or sprung back up under tension or compression of a spring (not shown) the teat assembly remains in place. The operation can be repeated for each successive feeding bottle 354. Alternatively a respective teat assembly arm 360 can be provided for each feeding bottle, moved intermediate adjacent feeding bottles during the filling operation and moved back into position and depressed simultaneously to close all of the feeding bottles. The feeding bottle and the teat assembly include register grooves, projections or other formations (not shown) to ensure that they are correctly oriented for immediate registration of the teat assembly and feeding bottle.

As discussed above, a sterile, easily drainable, tamper-evident set of feeding bottles and teats are thus prepared ready for prompt usage and can be stored in numbers. The bottles can for example be stored on an appropriate rack or indeed maintained on the station shown in FIG. 16. In the case of the variable angle neck bottle shown in FIG. 13, a further alternative possibility for storage of a sealed liner is shown in FIG. 17. In the arrangement shown a rack generally designated 380 comprises an elongate body with side walls dimensioned such that the upper portion 230*b* of the bottle body rests on the side walls with the liner 240 suspended from it. When it is desired to use the feeding bottle, and the liner and upper portion 230*b* are snapped onto a lower bottle body portion 230*a* as discussed in relation to FIG. 13 and used in the appropriate fashion. It will be appreciated that other forms of rack are contemplated—for example there may be more than one row of feeding bottles. In such an arrangement, in addition, the rack 380 can be heated, for example by filling with heated water or by providing heated sleeves associated with each liner, in order that the contents are kept at a desired temperature, for example by thermostatic control.

FIGS. 18*a* and 18*b* show an alternative embodiment in which a feeding bottle 420 includes a stopper assembly 422 of the type described above. The feeding bottle further includes a collar 424 and seal 426 again of the type described above. However the collar seals an alternative cover 428 to the feeding bottle 420. The cover 428 includes a mouthpiece assembly comprising a spout 430. The spout 430 is a twist fit to a cylindrical formation 432 on the cover 428. The cylindrical formation includes a central aperture 434 and the spout 430 includes a valve member 436 which cooperates with the aperture 434 to open and close the aperture against liquid flow designated by arrows A.

The valve member 436 includes a conical lower portion 438 and the aperture 434 preferably has corresponding tapered walls. The spout twists between positions 180° apart and is threadedly connected to the cover 428. In a first, upper position, therefore, the valve member is spaced from the aperture 434 allowing liquid flow. In a second, lower position the valve member 436 closes the aperture to prevent fluid flow. The mouthpiece is located on the feeding bottle so as to align in an appropriate feeding position as seen in FIG. 18*b* and moves between 180° spaced positions both of which are of course parallel to the aligned position. Because the mouthpiece is locate off-centre relative to the bottle body, the bottle is easier to hold and drink from, there being no obstruction to the baby's chin. In addition the vent will automatically be correctly positioned at the top of the vessel when it is in use—this feature can of course be applied to other mouthpieces and embodiments discussed above.

As a result the infant can be led on to the next stage of the feeding vessel and the mouthpiece assembly whilst the mother can still control the air inlet via the stopper assembly 422 in the manner discussed above.

It will be appreciated that variations of the disclosed components are possible without departing from the present invention. The components can be formed of a range of suitable materials such as plastic or rubber, that are preferably suitable for steam sterilisation. The components may also adopt a range of shapes compatible with the aims of the present invention. Aspects of the various embodiments can be combined with one another as appropriate.

What is claimed is:

1. A feeding bottle comprising:

a bottle body including an open end for mounting a teat assembly, and an air inlet; and a stopper assembly, the stopper assembly being mounted to the bottle body and including a stopper manually moveable between a closed position in which the air inlet is closed by the stopper, and an open position in which the air inlet is open;

wherein the stopper assembly further includes a stopper retainer separated from said stopper, said stopper retainer moveable between a first position in which the stopper retainer prevents movement of the stopper from the closed position to the open position and a second position in which the stopper retainer permits movement of the stopper between the open position and the closed position;

and wherein said stopper retainer is attached to said bottle body in said first position and in said second position.

2. A bottle as claimed in claim 1, in which the stopper is biased to the closed position.

3. A bottle as claimed in claim 1, in which the bottle body includes a base end, and the air inlet is provided at or near the base end.

4. A bottle as claimed in claim 1, in which when the bottle is held in one hand in use, the stopper is operable by one finger of the hand.

5. A bottle as claimed in claim 1, in which the stopper assembly is pivotal to move the stopper between the closed and open positions.

6. A bottle as claimed in claim 1, in which the stopper assembly is releasably attachable to the bottle body.

7. A battle as claimed in claim 1, in which the stopper assembly includes an aperture alignable with the air inlet.

8. A bottle as claimed in claim 1, further including a teat assembly, the teat assembly being reversible between a drinking position and a sealed position.

9. A bottle as claimed in claim 1, further comprising a liner receivable in the bottle body and having an air inlet formation cooperating with the bottle body inlet.

10. A bottle as claimed in claim 9 further comprising a piercing element for piercing the liner in the vicinity of the air inlet formation.

11. A bottle as claimed in claim 9, in which the air inlet formation is provided on an insert in the base of the liner.

12. A battle as claimed in any of claim 9, in which the liner is pre-filled with liquid and sealed.

13. A bottle as claimed in claim 9, in which the bottle body includes a lower portion and an upper portion, including said open end, movably attached to said lower portion between two or more angular positions.

14. A stopper assembly for a bottle as claimed in claim 1, the stopper assembly comprising a pivot arm bearing a stopper and a biasing element for biasing the stopper to a closed position.

* * * * *

UNITED STATES PATENT AND TRADEMARK OFFICE

CERTIFICATE OF CORRECTION

PATENT NO. : 6,786,345 B2
DATED : September 7, 2004
INVENTOR(S) : Richards

It is certified that error appears in the above-identified patent and that said Letters Patent is hereby corrected as shown below:

Column 16,
Line 20, delete the word "battle" and insert -- bottle --
Line 33, delete the word "battle" and insert -- bottle --

Signed and Sealed this

Fourteenth Day of December, 2004

JON W. DUDAS
*Director of the United States Patent and Trademark Office*